US007066249B2

(12) United States Patent
Simson

(10) Patent No.: US 7,066,249 B2
(45) **Date of Patent: *Jun. 27, 2006**

(54) CEMENTING MANIFOLD ASSEMBLY

(75) Inventor: James A. Simson, Meadows Place, TX (US)

(73) Assignee: Smith International, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/136,982

(22) Filed: May 25, 2005

(65) Prior Publication Data

US 2005/0211431 A1 Sep. 29, 2005

Related U.S. Application Data

(63) Continuation of application No. 10/209,339, filed on Jul. 31, 2002, now Pat. No. 6,904,970.

(60) Provisional application No. 60/310,293, filed on Aug. 3, 2001.

(51) Int. Cl.
*E21B 33/13* (2006.01)

(52) U.S. Cl. ..... 166/177.4; 166/75.15

(58) Field of Classification Search ..... 166/70, 166/75.15, 177.4, 291
See application file for complete search history.

(56) References Cited

U.S. PATENT DOCUMENTS

| | | | | |
|---|---|---|---|---|
| 3,076,509 | A | 2/1963 | Burns et al. | 166/70 |
| 3,920,075 | A | 11/1975 | Braddick et al. | 166/290 |
| 4,281,711 | A | 8/1981 | Braddick et al. | 166/118 |
| 4,345,651 | A | 8/1982 | Akkerman et al. | 166/291 |
| 4,281,711 | A | 2/1985 | Braddick et al. | 166/118 |
| 4,854,383 | A | 8/1989 | Arnold et al. | 166/70 |
| 5,165,703 | A | 11/1992 | Morvant | 277/188 |
| 5,236,035 | A | 8/1993 | Brisco et al. | 166/70 |
| 5,293,933 | A | 3/1994 | Brisco | 166/70 |
| 5,511,620 | A | 4/1996 | Baugh et al. | 166/387 |
| 5,950,724 | A | 9/1999 | Giebeler | 166/70 |
| 5,960,881 | A * | 10/1999 | Allamon et al. | 166/291 |
| 6,182,752 | B1 | 2/2001 | Smith, Jr. et al. | 166/70 |
| 6,491,103 | B1 * | 12/2002 | Allamon et al. | 166/318 |
| 6,672,384 | B1 * | 1/2004 | Pedersen et al. | 166/75.15 |

FOREIGN PATENT DOCUMENTS

EP 0 500 165 A1 8/1992

OTHER PUBLICATIONS

*Nodeco 'TDH' Top Drive Cementing Head*; Nodeco; Revised Dec. 15, 1995 08:02; (pp. 1).
*Linear Hanger Technical Unit; Model LC-2*™ Plug Dropping Head Product No. 278-31; Baker Oil Tools; Unit No. 4393, Index 350.00; Feb. 1995 (pp. 1-3).
UK Search Report for Appln. No. GB 0217887.9 dated Nov. 6, 2002; (pp. 3).
British Examination Report dated Oct. 4, 2004, Application No. GB 0217887.9, 2 pgs.

* cited by examiner

*Primary Examiner*—William Neuder
(74) *Attorney, Agent, or Firm*—Conley Rose, P.C.; Shannon W. Bates

(57) ABSTRACT

Apparatus for cementing a string of tubulars in a borehole comprises an enclosure having a bore therethrough, an axially fixed sphere canister having a sphere aperture therethrough, a sphere valve member having a valve body disposed internally of said bore, and a sphere disposed in said sphere aperture, wherein said sphere valve member has a hold position closing said sphere aperture and a drop position opening said sphere aperture to release said sphere.

43 Claims, 11 Drawing Sheets

CEMENTING MANIFOLD ASSEMBLY

CROSS-REFERENCE TO RELATED APPLICATIONS

This is a continuation application of U.S. patent application Ser. No. 10/209,339 filed Jul. 31, 2002 now U.S. Pat. No. 6,904,970 and entitled "Cementing Manifold Assembly", which claims the benefit under 35 U.S.C. § 119(e) of U.S. Provisional Application Ser. No. 60/310,293 filed Aug. 3, 2001 and entitled "Cementing Manifold", both hereby incorporated herein by reference for all purposes.

STATEMENT REGARDING FEDERALLY SPONSORED RESEARCH OR DEVELOPMENT

Not Applicable.

REFERENCE TO A MICROFICHE APPENDIX

Not applicable.

FIELD OF THE INVENTION

The present invention relates generally to apparatus and methods for cementing downhole tubulars into a well bore, and more particularly, the present invention relates to a cementing manifold assembly and method of use.

BACKGROUND

A well-known method of drilling hydrocarbon wells involves disposing a drill bit at the end of a drill string and rotating the drill string from the surface utilizing either a top drive unit or a rotary table set in the drilling rig floor. As drilling continues, progressively smaller diameter tubulars comprising casing and/or liner strings may be installed end-to-end to line the borehole wall. Thus, as the well is drilled deeper, each string is run through and secured to the lower end of the previous string to line the borehole wall. Then the string is cemented into place by flowing cement down the flowbore of the string and up the annulus formed by the string and the borehole wall.

To conduct the cementing operation, typically a cementing manifold is disposed between the top drive unit or rotary table and the drill string. Thus, due to its position in the drilling assembly, the cementing manifold must suspend the weight of the drill pipe, contain pressure, transmit torque, and allow unimpeded rotation of the drill string. When utilizing a top drive unit, a separate inlet is preferably provided to connect the cement lines to the cementing manifold. This allows cement to be discharged through the cementing manifold into the drill string without flowing through the top drive unit.

In operation, the cementing manifold allows fluids, such as drilling mud or cement, to flow therethrough while simultaneously enclosing and protecting from flow, a series of darts and/or spheres that are released on demand and in sequence to perform various operations downhole. Thus, as fluid flows through the cementing manifold, the darts and/or spheres are isolated from the fluid flow until they are ready for release.

Cementing manifolds are available in a variety of configurations, with the most common configuration comprising a single sphere/single dart manifold. The sphere is dropped at a predetermined time during drilling to form a temporary seal or closure of the flowbore of the drill string, for example, or to actuate a downhole tool, such as a liner hanger, in advance of the cementing operation, as for example. Once the cement has been pumped downhole, the dart is dropped to perform another operation, such as wiping cement from the inner wall of a string of downhole tubular members.

Another common cementing manifold comprises a single sphere/double dart configuration. The sphere may be released to actuate a downhole tool, for example, followed by the first dart being launched immediately ahead of the cement, and the second dart being launched immediately following the cement. Thus, the dual darts surround the cement and prevent it from mixing with drilling fluid as the cement is pumped downhole through the drill string. Each dart typically also performs another operation upon reaching the bottom of the drill string, such as latching into a larger dart to wipe cement from the string of downhole tubular members.

Many conventional cementing manifolds include external bypass lines such as the manifolds disclosed in U.S. Pat. No. 5,236,035 to Brisco et al. and U.S. Pat. No. 4,854,383 to Arnold et al., both hereby incorporated herein by reference for all purposes. In more detail, Arnold et al. discloses a conventional external bypass cementing manifold for a single dart or double dart configuration. The single dart manifold comprises a tubular enclosure with a longitudinal passageway into which a dart is loaded. The dart holding/dropping mechanism is a ball valve connected via threads to the bottom of the tubular enclosure. An external bypass line with a bypass valve is connected via welds or threads to the tubular enclosure around the dart. For the double dart configuration, an identical arrangement of tubular enclosure, ball valve, and external bypass line with bypass valve is connected below the first tubular enclosure. Each of the darts in the dual dart configuration is separately releasable.

When the dart is in the hold position, the ball valve remains closed to prevent flow through the tubular enclosure, and flow is routed around the dart through the bypass line by opening the bypass valve. To release the dart, the bypass valve is closed, and the ball valve is opened to allow flow through the tubular enclosure, thereby causing the dart to drop into the well string.

Conventional cementing manifolds often include other external connections, such as the side-mounted sphere dropping mechanisms disclosed in Arnold et al. and U.S. Pat. No. 5,950,724 to Giebeler, hereby incorporated herein by reference for all purposes. In more detail, Arnold et al. discloses a ball dropping mechanism comprising a housing that mounts to the side of the lowermost tubular enclosure. The housing includes a bore in fluid communication with the longitudinal passageway through the tubular enclosure. In the hold position, a ball is positioned on a seat within the housing bore. To drop the ball, a screw shaft pushes the ball through the housing bore and into the longitudinal passageway, thereby dropping the ball down into the well string.

A number of disadvantages are associated with cementing manifolds having external connections, such as external bypass lines and side-mounted sphere dropping mechanisms. In particular, several large penetrations are required in the main body of the manifold (i.e. the tubular enclosures) for making the external connections. These penetrations create high stress concentration areas and hydraulically loaded areas that reduce the overall pressure-containing capacity of the cementing manifold. The manifold must also be capable of withstanding fatigue caused by changes in operating conditions, and stress concentration areas minimize the fatigue life of a cementing manifold. Further, the ball drop mechanism and external bypass connections protrude a considerable distance from the main body of the manifold, making these components more prone to damage during well operations. In addition, the external components connect via threads or welds to the main body of the manifold, thereby presenting a safety concern. In particular, the threads could back out or the welds could fail, which would expose rig personnel to high pressure, high velocity fluids. Thus, it would be advantageous to provide a cementing manifold with internal bypass capability and with few external connections to the main body of the manifold. It would also be advantageous to eliminate threaded or welded connections to the main body of the manifold.

Some cementing manifolds have internal bypass capability, such as the TDH Top Drive Cementing Head offered by Weatherford/Nodeco. The TDH Head is purpose-built for use with a top-drive system and available in configurations to accommodate either a single ball/single dart, or single ball/dual darts. In both configurations, the TDH Head comprises a main body having a main bore and a parallel side bore, with both bores being machined integral to the main body. The darts are loaded into the main bore, and a dart releaser valve is provided below each dart to maintain it in the hold position. The dart releaser valves are side-mounted externally and extend through the main body. A port in the dart releaser valve provides fluid communication between the main bore and the side bore. The ball drop mechanism is externally side-mounted through one wall of the main body below the lowermost dart and extends into the main bore. The ball is retained by a collet, and to drop the ball, a screw shaft pushes the ball out into the main bore.

When circulating prior to cementing, the darts are maintained in the main bore with the dart releaser valves closed. Fluid flows through the side bore and into the main bore below the lowermost dart via the fluid communication port in the dart releaser valve. To release a dart, the dart releaser valve is turned 90 degrees, thereby closing the side bore and opening the main bore through the dart releaser valve. Flow enters the main bore behind the dart, causing it to drop downhole.

Although the TDH Top Drive Cementing Head eliminates external bypass lines, it includes large penetrations in the main body for the dart releaser valves and ball drop device. These external components are also welded or threaded to the main body and protrude a significant distance. Thus, many of the concerns associated with external bypass manifolds have not been eliminated. Further, the parallel flow bores restrict the flow capacity of the TDH unit, which could present erosion problems, and also make it more difficult to remove leftover cement that could clog the bores. Thus, it would be advantageous to provide a cementing manifold with internal bypass capability that does not restrict the flow capacity of the manifold.

The Model LC-2 Plug Dropping Head offered by Baker Oil Tools, a Baker Hughes Company, is an internal bypass cementing manifold for dropping either a dart or a sphere. The LC-2 comprises a mandrel with a releasable dart/sphere holding sleeve disposed therein, the sleeve being held in place by a rotatable lock pin. The sleeve includes ports that allow fluid bypass into an annular area while the sleeve is in the upper locked position. A pivoting stop extends across the bore of the mandrel below the sleeve to maintain the dart/sphere in the hold position.

To drop the dart or sphere, the lock pin is turned 180 degrees to the drop position, which releases the sleeve. The sleeve moves downwardly in response to gravity and fluid flow until it reaches a stop shoulder. The downward movement of the sleeve releases the pivoting stop and restricts flow through the ports leading to the annular bypass area. Thus, the pivoting stop rotates out of the path of the dart or sphere, and all fluid is directed longitudinally through the main bore of the sleeve behind the dart or sphere, causing it to drop down into the drill string.

Although the Model LC-2 Plug Dropping Head eliminates external bypass lines and other external components, the releasable sleeve presents disadvantages. Namely, if the sleeve gets hung up in the mandrel, flow will bypass the dart or sphere, thereby preventing its release. Further, because the lock pin provides only limited engagement with the sleeve, improper assembly or maintenance of the lock pin and sleeve connection could cause the sleeve to release prematurely. Thus, it would be advantageous to provide a cementing manifold with internal bypass capability that does not rely on a releasable sleeve as the dropping mechanism.

In addition to the disadvantages described above, conventional cementing manifolds are typically unitized and purpose-built such that they are not reconfigurable. For example, they can not be converted from a single dart manifold to a double dart manifold and vice versa as the job requires. Further, after the manifold has been used for one job, new darts and/or spheres can not be loaded at the rig site due to the high torques required to disconnect the components to allow reloading. Thus, traditional cementing manifolds must be redressed and reloaded in the shop after each use. In addition, some designs do not enable release of the darts or spheres while pumping fluid downhole due to fluid loads on the release mechanisms. Therefore, known cementing manifolds present various additional operating and maintenance disadvantages.

The present invention overcomes the deficiencies of the prior art.

SUMMARY

The present invention relates to apparatus for cementing a string of tubulars in a borehole, the apparatus comprising an enclosure having a bore therethrough, an axially fixed sphere canister having a sphere aperture therethrough, a sphere valve member having a valve body disposed internally of said bore, and a sphere disposed in said sphere aperture, wherein said sphere valve member has a hold position closing said sphere aperture and a drop position opening said sphere aperture to release said sphere.

In another embodiment, an apparatus for cementing a string of tubulars in a borehole comprises an upper member, a first launching unit including a first dart canister and a first dart valve member disposed within a first modular member, a second launching unit including a second dart canister and a second dart valve member disposed with a second modular member, and a third launching unit including a sphere canister and a sphere valve member disposed within a lower member, wherein at least one of said canisters is axially fixed, and wherein at least one of said dart valve members comprises a valve body disposed internally of a bore within at least one of said modular members.

Other aspects and advantages of the invention will be apparent from the following description and the appended claims. The various characteristics described above, as well as other features, will be readily apparent to those skilled in the art upon reading the following detailed description, and by referring to the accompanying drawings.

BRIEF DESCRIPTION OF THE DRAWINGS

For a more detailed description of the present invention, reference will now be made to the accompanying drawings, wherein.

DETAILED DESCRIPTION

Figure 1:
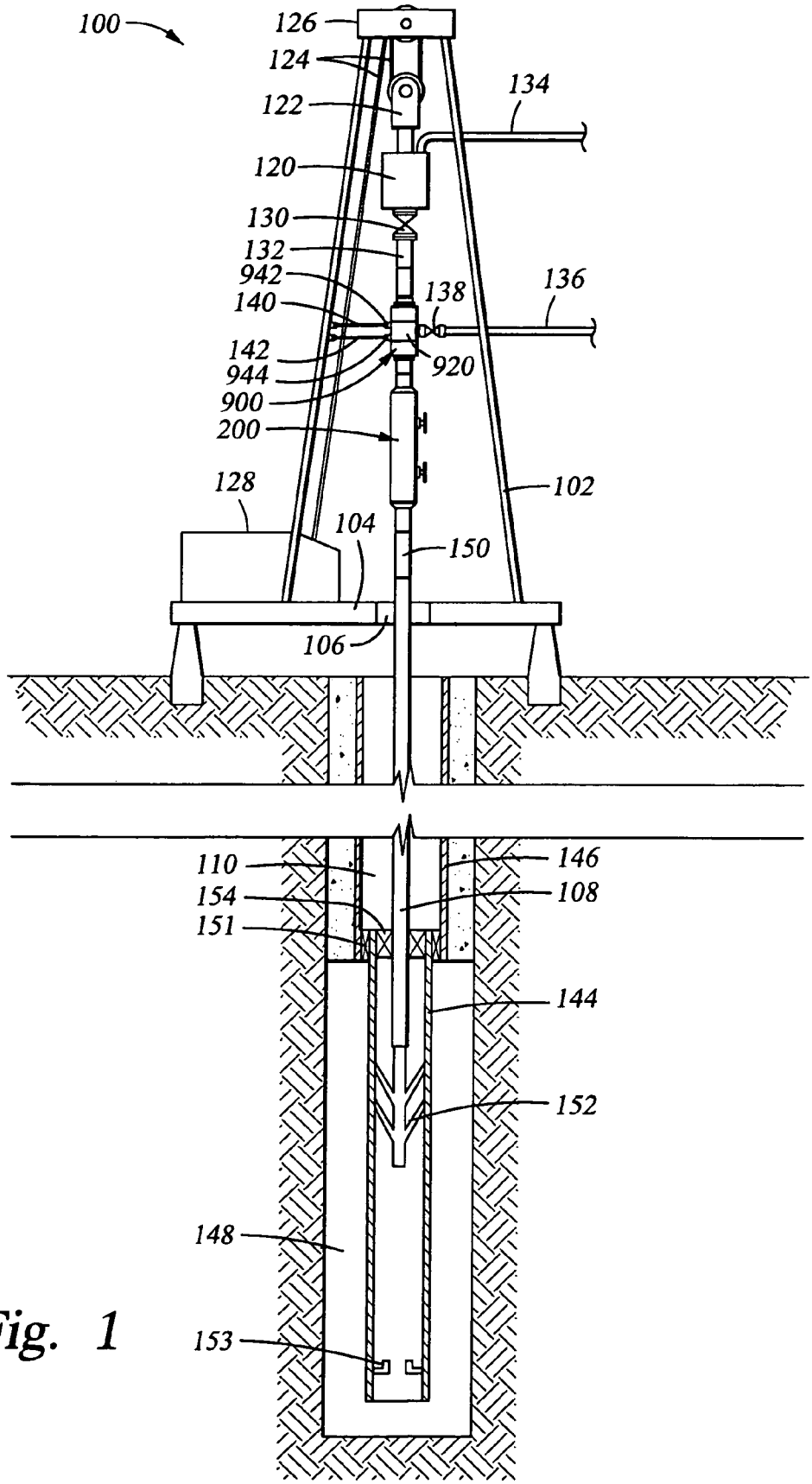
FIG. 1 schematically depicts an exemplary drilling system in which the various embodiments of the present invention may be utilized.

Preferred embodiments of the invention are shown in the above-identified Figures and described in detail below. In describing the preferred embodiments, like or identical reference numerals are used to identify common or similar elements.

FIG. 1 schematically depicts an exemplary drilling system in which the present invention may be utilized. However, one of ordinary skill in the art will understand that the preferred embodiments are not limited to use with a particular type of drilling system. The drilling rig 100 includes a derrick 102 with a rig floor 104 at its lower end having an opening 106 through which drill string 108 extends downwardly into a well bore 110. The drill string 108 is driven rotatably by a top drive drilling unit 120 that is suspended from the derrick 102 by a traveling block 122. The traveling block 122 is supported and moveable upwardly and downwardly by a cabling 124 connected at its upper end to a crown block 126 and actuated by conventional powered draw works 128. Connected below the top drive unit 120 is a kelly valve 130, a pup joint 132, a cementing swivel 900, and a cementing manifold, such as the single dart/single sphere cementing manifold 200 of the present invention. A flag sub 150, which provides a visual indication when a dart or sphere passes therethrough, is connected below the cementing manifold 200 and above the drill string 108. A drilling fluid line 134 routes drilling fluid to the top drive unit 120, and a cement line 136 routes cement through a valve 138 to the swivel 900.

Figure 11:
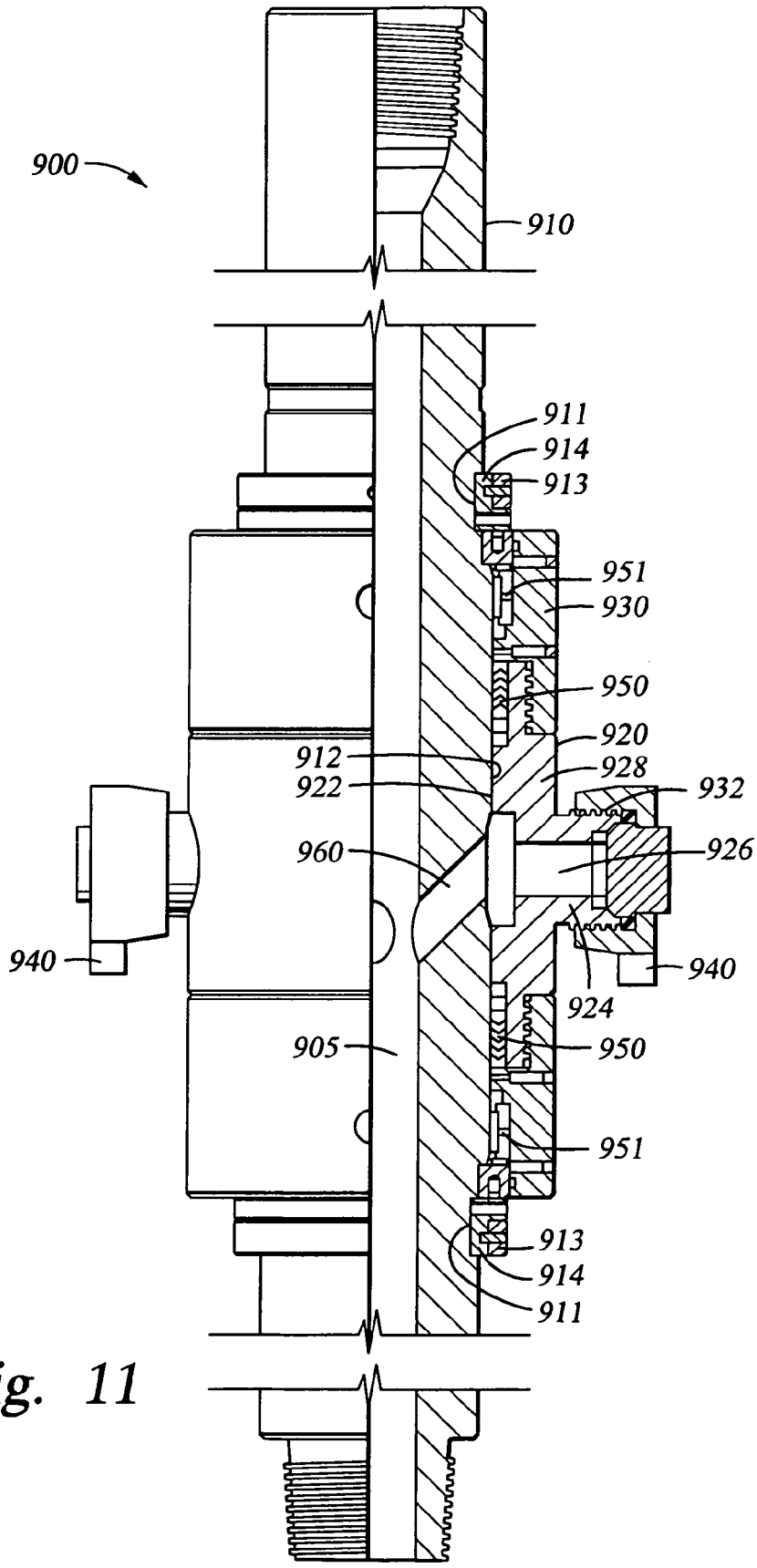
FIG. 11 is a side view, partially in cross-section, of a preferred embodiment of a cementing swivel of the present invention.

Any cementing swivel may be utilized, but preferably the cementing swivel 900 is configured as shown in FIG. 11. Referring now to FIGS. 1 and 11, the swivel 900 includes a mandrel 910, a housing 920, and a cap 930, with upper and lower seal assemblies 950 disposed above and below a cement port 960 and between the mandrel 910 and the housing 920. The swivel 900 preferably provides cement line connections 940 and tie-off connections 942, 944 (shown in FIG. 1) that are integral to the housing 920, thereby avoiding the disadvantages of conventional swivel connections that are typically threaded, welded, or bolted on. The threaded and bolted connections can come loose over time, and the welded connections are subject to damage or failure due to corrosion at the weldment. Conventional swivel connections are further subject to fatigue caused by the weight of the overhanging cement line 136 and cement valve 138 that connect thereto. Mandrel 910 includes upper and lower threaded connections for connecting the upper end of mandrel 910 to top drive unit 120 and the lower end to the cementing manifold 200 connected to the upper end of drill string 108.

The housing 920 includes one or more radially projecting integral conduits 924 with a cement port 926 extending through conduit 924 and the wall 928 of housing 920. Housing 920 and conduits 924 are preferably made from a common tubular member such that conduits 924 are integral with housing 920 and do not require any type of fastener including welding. Conduit 924 provides a connection means, such as threads 932, for connecting cement line 136 to swivel 900.

The preferred swivel 900 also includes two swivel connections 940 for redundancy in case one connection 940 becomes damaged. The cement ports 960 within the mandrel 910 are preferably angled so that as cement flows through the connection 940, it enters the throughbore 905 of the mandrel 910 generally in the downwardly direction. This allows the cement to impinge on the wall of throughbore 905 at an angle and minimizes erosion of the ports 960 and mandrel 910.

An additional feature of the preferred swivel 900 is that the mandrel 910 includes a common cylindrical outer surface 912 in the areas of the bearings 951 and seal assemblies 950, which are disposed in recessed areas in the housing 920. Conventional mandrels included a step shoulder on the mandrel for the seals, requiring individual seal placement. The common cylindrical outer surface 912 of the mandrel 910 allows for the bearings 951 and seal assemblies 950 to be positioned within the housing 920 as one unit, such that the mandrel 910 can then slide through the bore 922 of the housing 920 and assembled cap 930. A groove 911 is provided at each end of the mandrel 910, and an externally threaded, split cylindrical ring 914 is positioned within the grooves 911. An internally threaded ring 913 is screwed onto the split ring 914, and these rings 913, 914 hold the assembled housing 920 and cap 930 in place on the mandrel 910.

Referring again to FIG. 1, in operation, drilling fluid flows through line 134 down into the drill string 108 while the top drive unit 120 rotates the drill string 108. The housing 920 of cementing swivel 900 is tied-off to the derrick 102 via lines or bars 140, 142 such that the swivel housing 920 cannot rotate and remains stationary while the mandrel 910 of the swivel 900 rotates within housing 920 to enable the top drive unit 120 to rotate the drill string 108.

To perform an operation such as, for example, actuating a downhole tool to suspend a tubular 144, such as a casing string or liner, from existing and previously cemented casing 146, a sphere may be dropped from the cementing manifold 200. Then, once the tubular 144 is suspended from the casing 146 via a rotatable liner hanger 151, cement will be pumped down through the drill string 108 and through the tubular 144 to fill the annular area 148 in the uncased well bore 110 around the tubular 144. To start the cementing operation, the kelly valve 130 is closed, and the valve 138 to the cement line 136 is opened, thereby allowing cement to flow through the swivel 900 and down into the drill string 108. Thus, the swivel 900 enables cement flow to the drill string 108 while bypassing the top drive unit 120.

It is preferable to rotate the drill string 108 during cementing to ensure that cement is distributed evenly around the tubular 144 downhole. More specifically, because the cement is a thick slurry, it tends to follow the path of least resistance. Therefore, if the tubular 144 is not centered in the well bore 110, the annular area 148 will not be symmetrical, and cement may not completely surround the tubular 144. Thus, it is preferable for the top drive unit 120 to continue rotating the drill string 108 through the swivel 900 while cement is introduced from the cement line 136. When the appropriate volume of cement has been pumped into the drill string 108, a dart is typically dropped from the cementing manifold 200 to latch into a larger dart 152 to wipe cement from the tubular 144 and land in the landing collar 153 adjacent the bottom end of the tubular 144.

Although FIG. 1 depicts one example drilling environment in which the preferred embodiments of the present invention may be utilized, one of ordinary skill in the art will readily appreciate that the preferred embodiments of the present invention may be utilized in other drilling environments such as, for example, to cement casing into an offshore wellbore.

Figure 2:
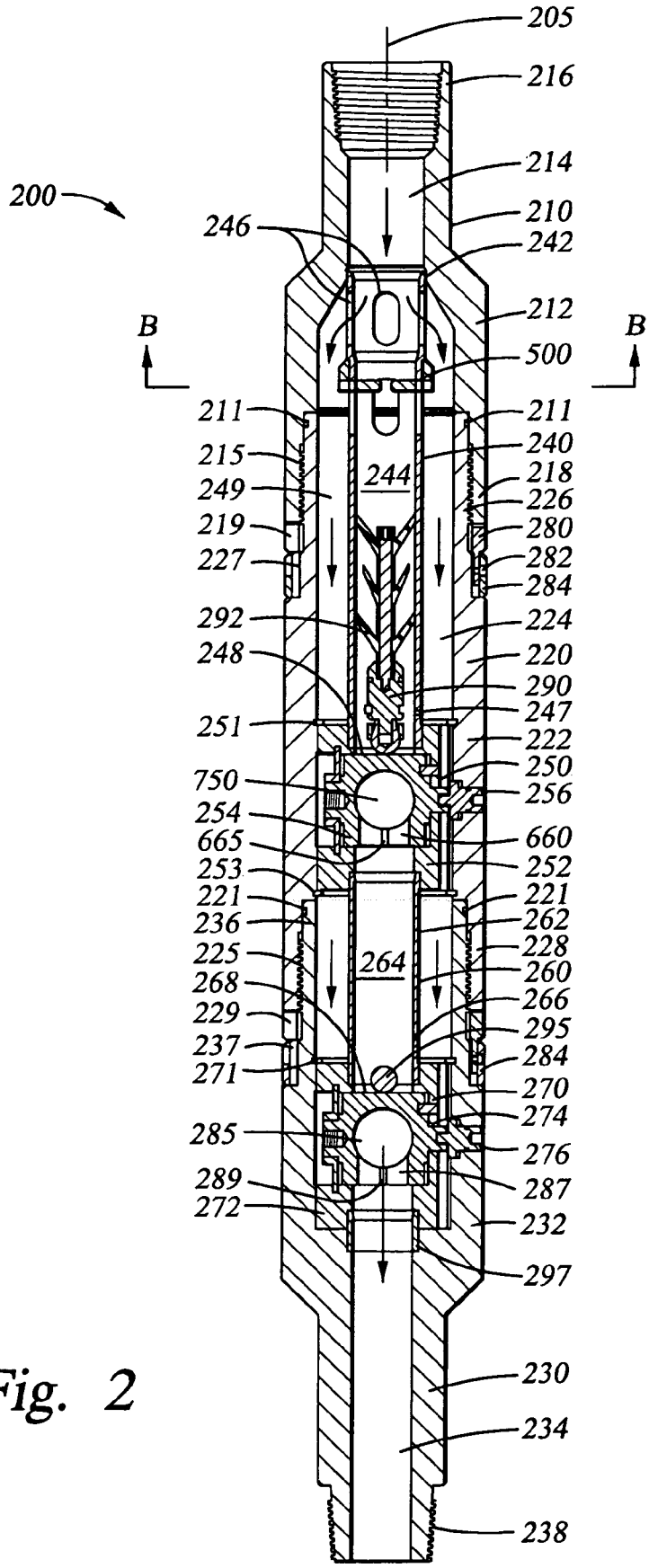
FIG. 2 is a cross-sectional side view of a preferred embodiment of a single dart/single sphere cementing manifold of the present invention, with both valves in the closed position.
Figure 3:
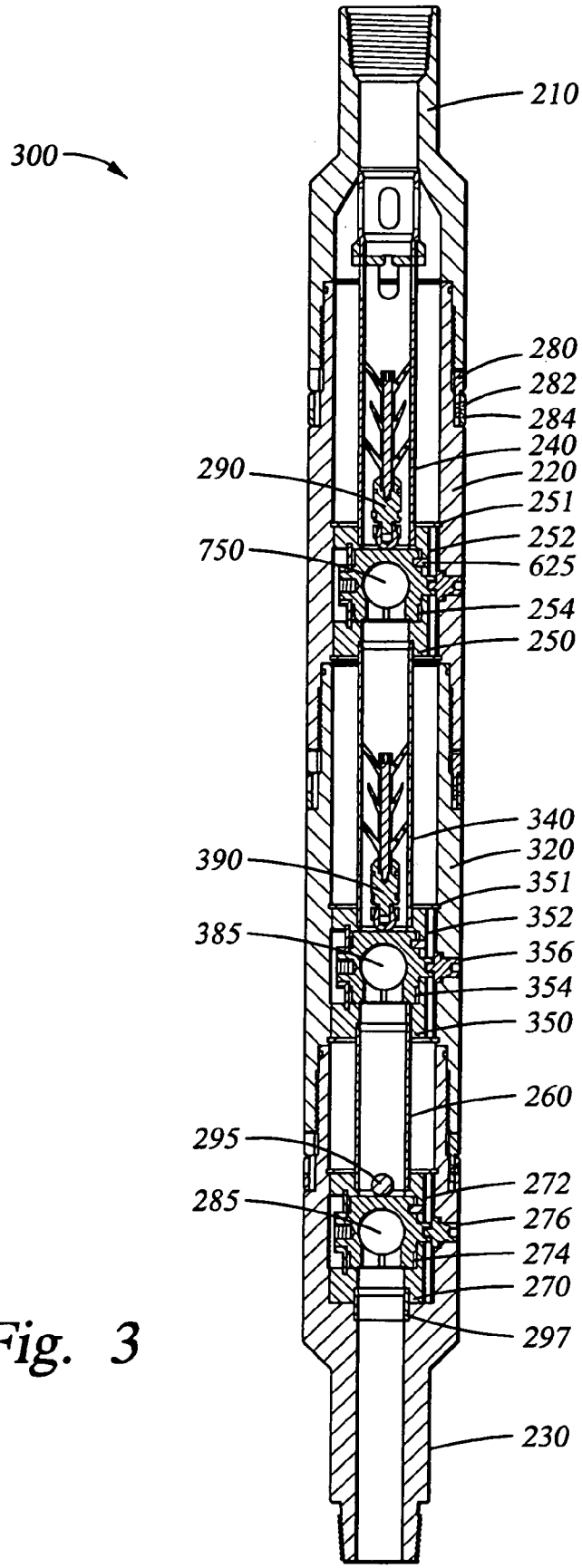
FIG. 3 is a cross-sectional side view of a preferred embodiment of a double dart/single sphere cementing manifold of the present invention, with all valves in the closed position.
Figure 4:
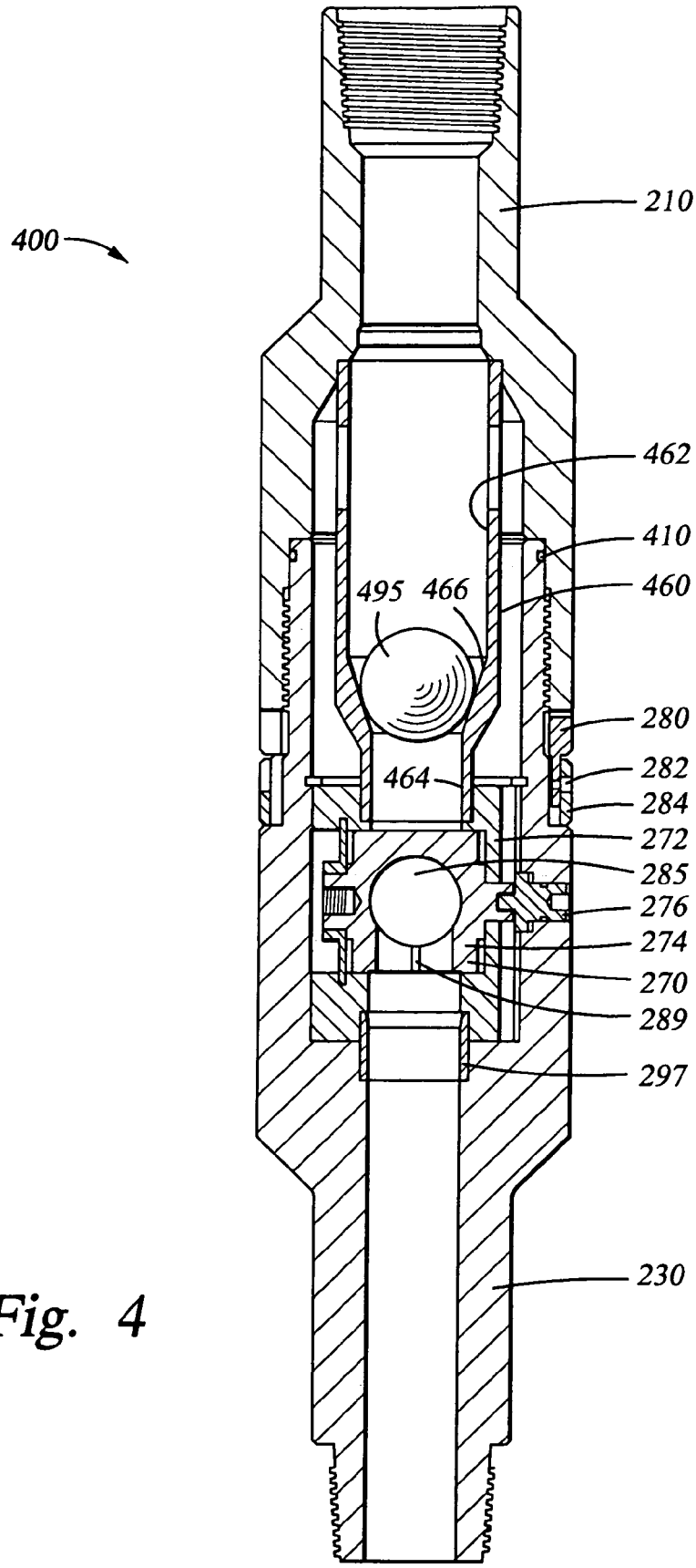
FIG. 4 is a cross-sectional side view of a preferred embodiment of a single large sphere cementing manifold of the present invention, with the valve in the closed position.

Referring now to FIG. 2–4, the preferred embodiments of the cementing manifold of the present invention may be provided in a variety of different configurations including a single dart/single sphere manifold 200 as shown in FIG. 2, a double dart/single sphere manifold 300 as shown in FIG. 3, or a single large sphere manifold 400 as shown in FIG. 4.

Referring now to FIG. 2, the single dart/single sphere manifold 200 comprises an upper cap 210, a housing 220, and a lower cap 230. The upper cap 210 comprises a body 212 having a longitudinal throughbore 214, a box connection end 216 for attachment to another tool, such as the swivel 900 shown in FIG. 11, and a lower threaded box end 218 which is castellated forming preferably six circumferentially disposed slots 219 for aligning with the upper end of housing 220. The housing 220 comprises a body 222 having a longitudinal throughbore 224, an upper threaded pin end 226 which is also castellated forming preferably six circumferentially disposed slots 227 for aligning with the lower castellated end of upper cap 210, and a lower threaded box end 228 which is castellated having preferably six circumferentially disposed slots 229 for aligning with the upper castellated end of lower cap 230. The lower cap 230 comprises a body 232 having a longitudinal throughbore 234, an upper threaded pin end 236 which is castellated having preferably six circumferentially disposed slots 237 for aligning with the lower castellated end of housing 220, and a lower pin connection end 238 for attachment to another tool, such as a flag sub 150, or directly to the drill string 108.

The upper cap 210, housing 220, and lower cap 230 form an enclosure that is load bearing and pressure containing. The box end of upper cap 210 connects to the pin end of housing 220 preferably via threads 215, and high pressure seals 211 are provided therebetween. The high pressure seals 211 are provided for pressure and fluid containment. The respective slots 219, 227 in the upper cap 210 and housing 220 are also aligned, then dogs 280 are installed in every other set of aligned slots 219, 227, and a cap screw 282 fixes each dog 280 into place. A circumferential ring 284 maintains all dogs 280 in place circumferentially.

Similarly, the box end of housing 220 and the pin end of lower cap 230 connect via threads at 225 with high pressure seals 221 provided therebetween, and dogs 280 are preferably positioned in every other set of aligned slots 229, 237 of the housing 220 and lower cap 230, respectively. Each dog 280 is held in place via a cap screw 282, and a circumferential ring 284 maintains all dogs 280 in position.

Disposed within the throughbores 214, 224 of the upper cap 210 and housing 220 is a dart canister 240 having a cylindrical body 242 with a throughbore 244 into which a dart 290 is loaded. The cylindrical body 242 includes flow slots 246 circumferentially disposed around the upper end, an equalizing port 247 adjacent the lower end, and a seal 248 at the lowermost end. The flow slots 246 provide a fluid path from the throughbore 214 of the upper cap 210 to the annular area 249 in the housing throughbore 224 around the dart canister 240. The equalizing port 247 enables pressure equalization when the fins 292 of the dart 290 form a seal with canister 240 that traps pressure in the canister 240.

Figure 5:
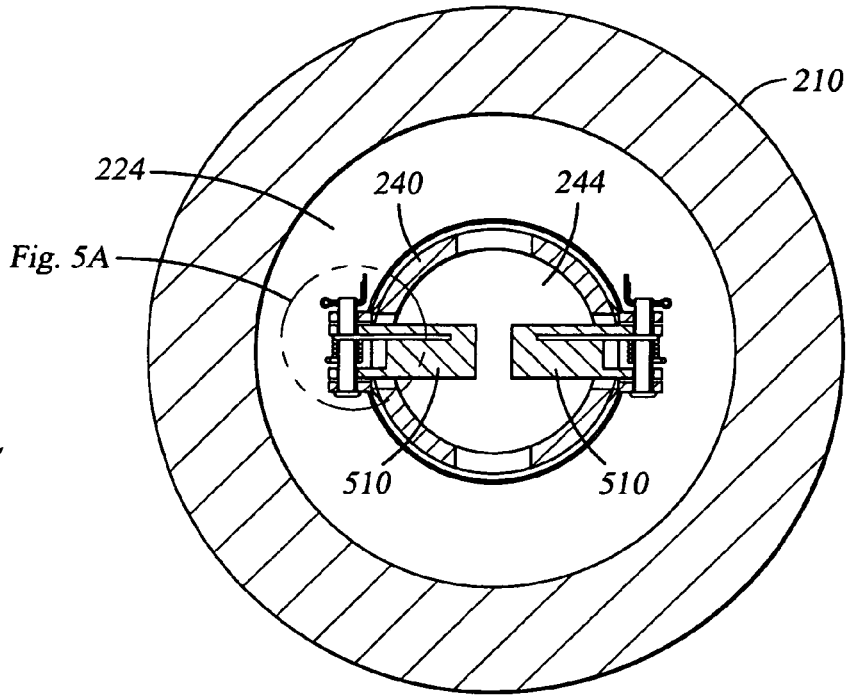
FIG. 5 is a cross-sectional bottom view through Section B—B of FIG. 2, with FIG. 5A being an enlargement of a detail of FIG. 5.
Figure 5A:
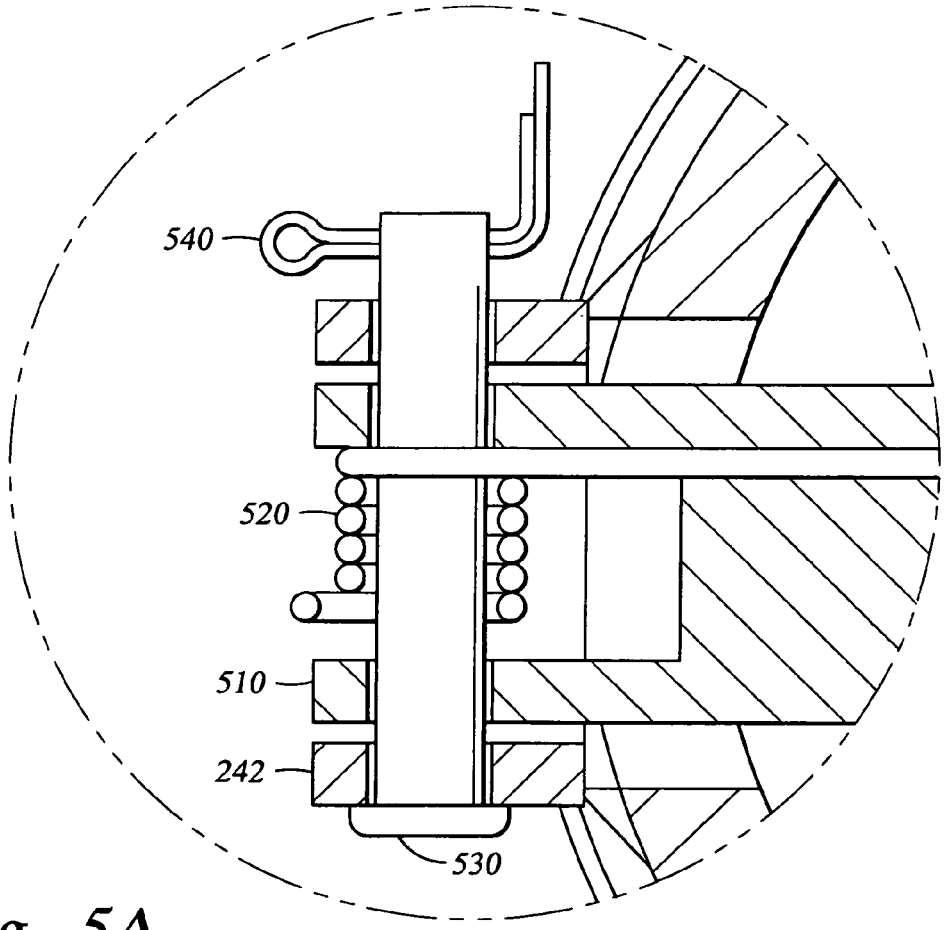

At the upper end of the dart canister 240, a retention mechanism 500 prevents the dart 290 from floating upwardly out of the upper end of canister 240. FIG. 5 depicts a cross-sectional bottom view of the retention mechanism 500 taken at Section B–B of FIG. 2, and FIG. 5A depicts an enlarged view of the connection details. The retention mechanism 500 comprises two fingers 510, each finger 510 extending approximately halfway across the diameter of the throughbore 244 of the dart canister 240. The fingers 510 are connected such that they are only capable of a hinged movement downwardly into the canister 240, and the fingers 510 are biased to the position shown in FIG. 2 and FIG. 5 by a torsional spring 520. The fingers 510 connect to the dart canister 240 by a clevis pin 530 that extends through the body 242 of the dart canister 240, through the end of the finger 510, and through the torsional spring 520. A cotter pin 540 is provided at the end of the clevis pin 530 to prevent pin 530 from backing out.

Referring again to FIG. 2, a first valve 250 is positioned within the housing 220 and below the dart canister 240 to act as a dart holding/dropping mechanism. The first valve 250 comprises a body 252, a rotatable plug 254, and an actuating stem 256 to enable manual or remote actuation of the plug 254 within the body 252 of valve 250. Retainer rings 251, 253 are disposed in shoulders of the housing 220 above and below the body 252 to properly position the valve 250 in the housing 220.

Below the first valve 250, and disposed within the housing 220 and the lower cap 230 is a sphere canister 260, which has a cylindrical body 262 with a throughbore 264. A sphere 295 fits within the throughbore 264, and the cylindrical body 262 includes an equalizing port 266 adjacent the lower end, and a seal 268 at the lowermost end. The equalizing port 266 enables pressure equalization should the sphere 295 form a seal with canister 260 that traps pressure in the canister 260. A second valve 270 is positioned within the lower cap 230 and below the sphere canister 260 to act as a sphere holding/dropping mechanism. The second valve 270 is preferably identical to the first valve 250 so as to be interchangeable and comprises a body 272, a rotatable plug 274, and an actuating stem 276 for manual or remote actuation of plug 274 within body 272 of the valve 270. A retainer ring 271 is disposed in a shoulder of the lower cap 230 above the valve body 272 to properly position the second valve 270 in the lower cap 230. A sleeve 297 is provided as a spacer to fit between the counterbore in the body 272 of the valve 270 and the lower cap 230, which enables adjustable spacing and interchangeable parts.

Figure 6:
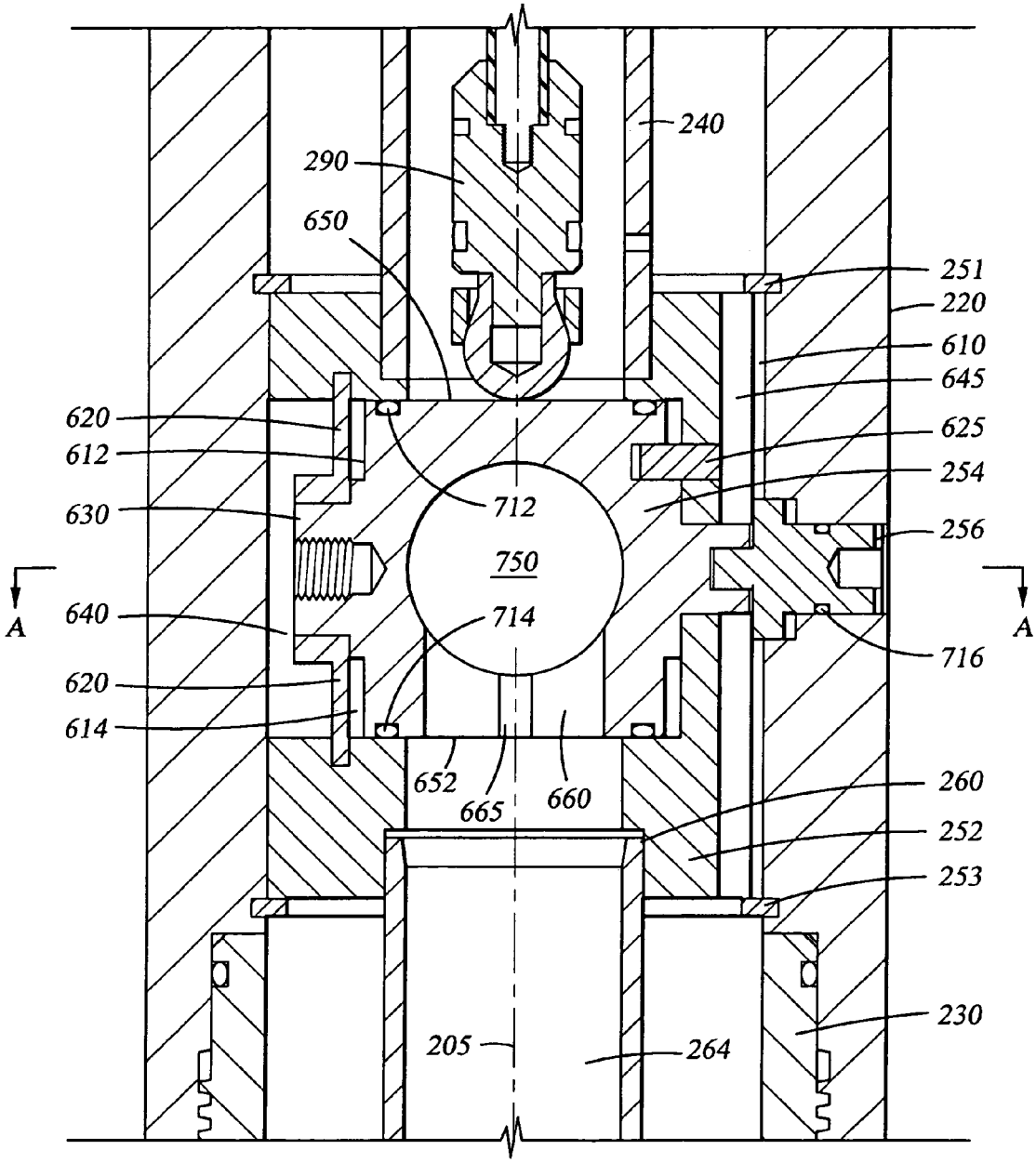
FIG. 6 is an enlarged view of a valve of the cementing manifold of FIG. 2.
Figure 7:
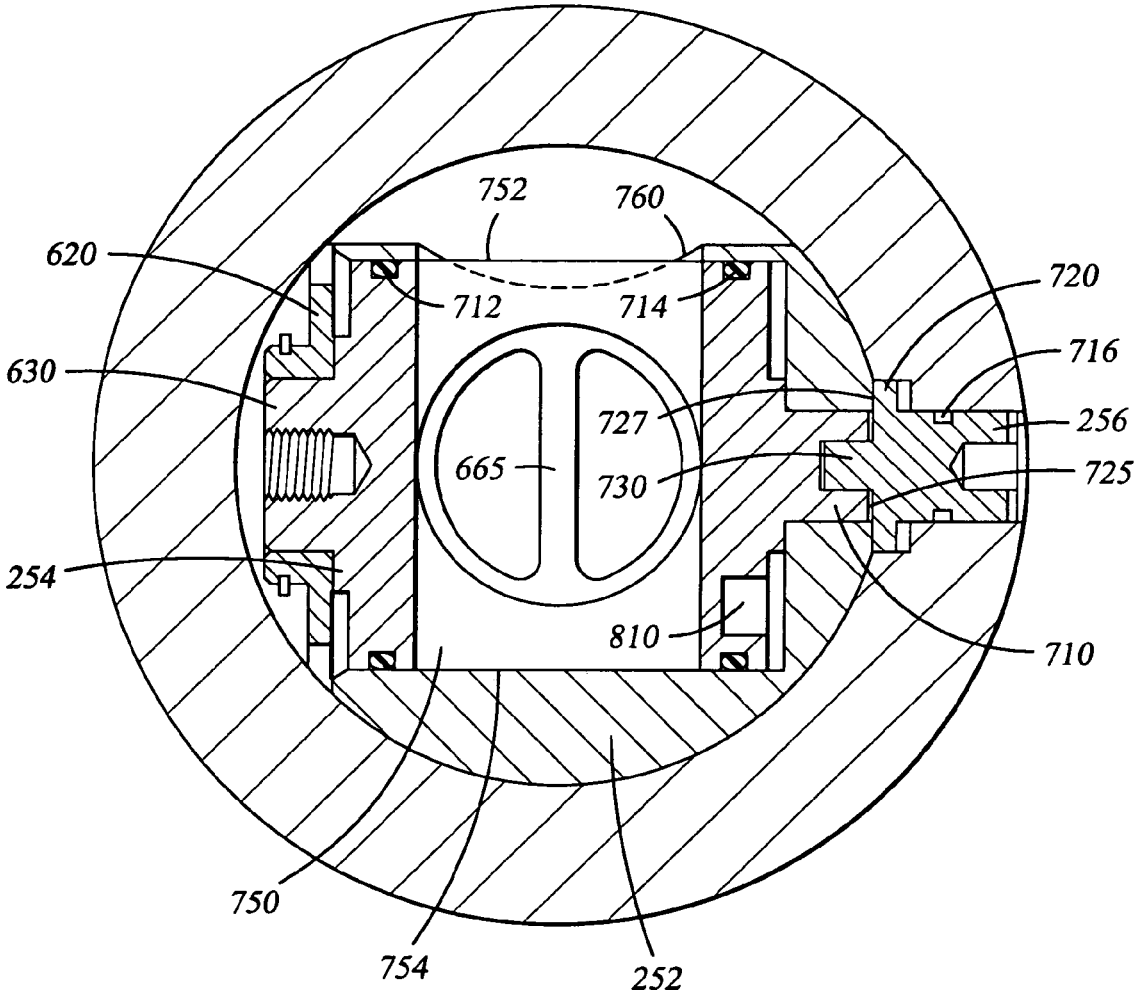
FIG. 7 is a cross-sectional top view of the valve of FIG. 6, taken along Section A—A.
Figure 8:
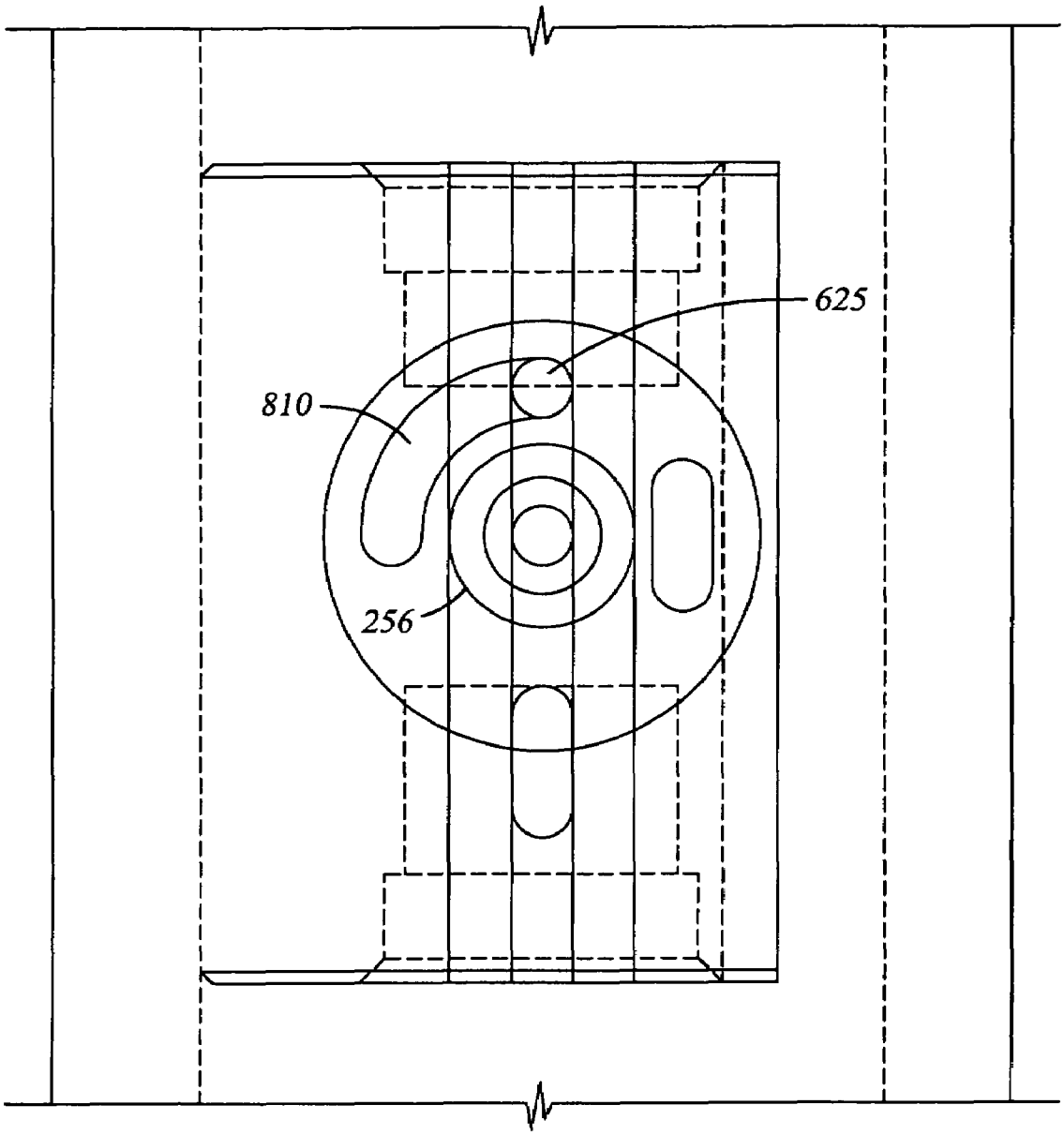
FIG. 8 is an end view of a valve stem of FIG. 6.

FIGS. 6–8 depict enlarged views of the components of the first valve 250 in more detail. Preferably the second valve 270 is identical to the first valve 250 in construction and operation so that the valves 250, 270 are interchangeable. Thus, only the first valve 250 is described in detail. FIG. 6 provides an enlarged view of the first valve 250 within the manifold of FIG. 2, FIG. 7 provides a cross-sectional top view of the same valve 250 taken along Section A—A of FIG. 6, and FIG. 8 provides an end view of the valve stem 256. Valve 250 includes an upper milled slot 610 along the length of the body 252 to enable installation of the valve 250 into the housing 220. Slots 612, 614 are also milled into the lower portion of the body 252 to accept a plug retainer plate 620, which is a split plate disposed above and below the plug 254 to position the plug 254 with respect to the body 252. The retainer plate 620 is designed to encircle a boss 630 on one side of the plug 254 that enables rotation between the valve body 252 and valve plug 254. O-rings 712, 714 are provided between the valve body 252 and plug 254 primarily to protect the valve 250 from contamination caused by debris rather than to provide pressure containment.

The plug 254 includes a throughbore 750 with a first end 752 and a second end 754, a transverse bore 660 having an open port 652 with a fouling bar 665 disposed across the diameter of the open port 652, and a closed side 650 opposite transverse bore 660. The transverse bore 660 extends perpendicularly to the throughbore 750 and communicates therewith. The fouling bar 665 is provided to prevent the sphere 295 from floating into the valve 750 and interfering with its operation. Although the plug 254 is depicted as being cylindrical in shape, one of ordinary skill in the art will appreciate that the plug 254 may be provided in a variety of shapes such as, for example, a spherical shape.

A pin 625 is provided between the valve body 252 and the valve plug 254. The pin 625 enables proper alignment of the valve plug 254 within the body 252 so that the valve 250 is installed in the closed or hold position as shown in FIG. 2 and in FIG. 7. The pin 625 is shown in top view in FIG. 8 disposed in a travel slot 810 that only allows a 90° rotation of the valve 250 from the closed, dart holding position to the open, dart dropping position. Thus, the pin 625 aligns the valve 250 properly to be installed in the closed position and also allows the valve 250 to travel only 90° between the hold and the drop positions.

Referring to FIG. 7, the stem 256 is installed in an aperture in the wall of housing 220 and includes a high-pressure seal 716 engaging housing 220 for pressure and fluid containment, and a flange 720 that prevents the stem 256 from being forced out of the aperture of housing 220 via fluid pressure. Thrust bearings 725 between the flange 720 and housing 220 offset the frictional load exerted on the interior face 727 of the flange caused by fluid pressure inside of the valve 250. Thus, the bearings 725 eliminate the pressure-induced frictional load, thereby allowing the stem 256 to rotate.

Referring to FIG. 6, any voids in the cementing manifold 200, such as the void 640 below the retainer plate 620 in the body 252 of the valve 250 and the gap 645 between the plug 254 and the milled slot 610 in the valve body 252 can potentially become filled with cement or other debris. If the cement hardens in such voids and gaps, then the manifold 200 will require excessive torque to actuate and will not otherwise operate properly. Thus, in the preferred embodiments of the present invention, all voids, such as void 640, and all gaps, such as gap 645, would be filled with a solid metal part or a flexible filler material, such as urethane, or a silicone or a rubber boot so that cement and other debris can not enter the area and harden.

Referring to FIG. 6 and FIG. 7, to assemble the valve 250 into the housing 220, the retainer ring 251 is installed. Then the stem 256, with the high pressure seal 716 and thrust bearings 725, is installed from inside the housing 220, thereby ensuring that the stem 256 can never be removed or loosened inadvertently. Due to the milled slot 610 along the length of the valve 250, the valve body 252 and plug 254 can be assembled into the housing 220 as shown in FIG. 7, oriented such that the protruding key 730 of the stem 256 fits into the protruding slot portion 710 of the plug 254, which ensures that the valve 250 is installed in the closed position.

Referring now to FIG. 2, the single dart/single sphere cementing manifold 200 is depicted in the holding position before the sphere 295 or the dart 290 are dropped, with both the first valve 250 and the second valve 270 in the closed position. To load the dart 290 and sphere 295 into the cementing manifold 200 as shown in FIG. 2, the first valve 250 is opened and the second valve 270 is closed. The sphere 295 is rolled into the manifold 200 through the upper cap 210, through the dart canister 240, through the first valve 250, and into the sphere canister 260 until the sphere 295 engages the closed second valve 270. Then the first valve 250 is closed, and a dart 290 is installed into the throughbore 214 of the upper cap 210. The fins 292 of the dart 290 engage the body 242 and collapse within the dart canister 240 such that the dart 290 must be pushed down into the throughbore 244 of the dart canister 240 until the bottom of the dart 290 engages the closed side 650 of first valve 290.

Preferably, once the sphere 295 and dart 290 have been dropped from the manifold 200, the manifold 200 can then be reloaded in the field. However, in larger sizes, the dart 290 may be too large to be forced into the througbore 244 of the dart canister 240 without mechanical assistance. Therefore, in an alternative embodiment, the dart canister 240 is provided as a two-piece component having upper and lower portions such that the upper portion of the dart canister 240 is removable to enable loading of larger-sized darts 290. Thus, the cementing manifold 200 is preferably designed to allow for reloading in the field so that the manifold 200 may be moved from rig to rig and only returned to the shop when necessary for redressing and workover rather than after each job for reloading.

As previously described, the upper cap 210 is threadingly connected at 215 to the housing 220, and the housing 220 is threadingly connected at 225 to the lower cap 230. During operation, the top drive unit 120 exerts high torque on the cementing manifold 200, which tends to tighten up the threaded connections 215, 225. Then, to reload the cementing manifold 200 after the sphere 295 and dart 290 have been dropped, the upper cap 210, the housing 220, and the lower cap 230 must be broken out from one another at the threads 215, 225, which would typically require high torques, such as those exerted by the top drive unit 120.

To enable isolation of the threaded connections 215, 225 without fully preloading the connections 215, 225 with make-up torque, the slots 219 of the castellated box end 218 of upper cap 210 are matched up with the slots 227 of the castellated pin end 226 of the housing 220. Similarly, the slots 219 of the castellated box end 228 of housing 220 are matched up with the slots 237 of castellated pin end 236 in the lower cap 230. For purposes of preventing tightening at the threads 215, 225, only three sets of mating slots disposed 120 degrees apart is preferred, but three additional sets of mating slots are preferably provided circumferentially on each of the upper cap 210, housing 220 and lower cap 230 to enable alignment of the valve stems 256, 276 that extend through the housing 220 and lower cap 230, respectively, to within 30 degrees. It is preferred, but not required, that the valve stems 256, 276 extend from the same side of the manifold 200 for ease of manual actuation.

In more detail, when the housing 220 and the lower cap 230 are threaded together at 225, for example, the mating slots 229, 237 on the housing 220 and the lower cap 230, respectively, may be mis-aligned. In that circumstance, the threaded connection 225 is backed off enough to align the slots 229, 237 so that dogs 280 can be installed in every other set of the slots 229, 237. Although the slots 229, 237 may be aligned, however, it is also preferred that the valve stems 256, 276 extend from the same side of the cementing manifold 200. Therefore, the threads 225 may need to be backed off 180° to achieve the preferred position of the two valve stems 256, 276. Positioning the valve stems 256, 276 is especially preferred when the valves 250, 270 are physically opened and closed by manual operation. Thus, with the valve stems 256, 276 on the same side of the manifold 200, an operator that goes up on a line to open the valves 250, 270 in the proper sequence can easily identify which is the second valve 270 and which is the first valve 250.

Once proper alignment has been achieved, dogs 280, that are capable of withstanding the rated torque of the top-drive unit 120, are installed into the aligned sets of slots to isolate the threaded connections 215, 225. The dogs 280 are installed and held in place by a circumferential ring 284 that fits over all of the dogs 280. The ring 284 includes equally spaced apertures (not shown) that equal the number of dogs 280 to be installed, such that the dogs 280 may be installed one at a time. The ring 284 fits over all of the mated slots between two components, such as slots 229, 237 between the housing 220 and the lower cap 230. The apertures through the ring 284 are positioned to allow for a dog 280 to be installed into preferably every other set of slots 229, 237. Then a cap screw 282 is threaded through each dog 280 to hold the dogs 280 in position. Once all the dogs 280 have been installed, the ring 284 is rotated to dispose the apertures over empty sets of slots 229, 237. In this position, the ring 284 will prevent the loaded dogs 280 from backing out, even if the cap screws 282 come loose. The dogs 280 and ring 284 are designed to be flush with the exterior surface of the manifold 200. An identical procedure is followed to install dogs 280 into mated slots 219, 227 between the upper cap 210 and the housing 220 utilizing another circumferential ring 284.

To describe the flow path through the cementing manifold 200, reference will now be made to FIG. 2, FIG. 6, and FIG. 7. FIG. 2 provides a cross-sectional view of the cementing manifold 200 in the holding position, with first and second valves 250, 270 closed. Referring to FIG. 6, which depicts an enlarged view of the first valve 250 in the position shown in FIG. 2, the closed side 650 of the valve plug 254 is positioned against the dart canister 240, the throughbore 750 is disposed perpendicular to the longitudinal axis 205 of the manifold 200, and the transverse bore 660 is facing downwardly in fluid communication with the throughbore 264 of the sphere canister 260. The fouling mechanism 665 is positioned in the transverse bore 660 so as to prevent the sphere 295 from floating upwardly to inhibit the operation of the first valve 250. The design of the valve plug 254 ensures that no hydraulically induced loads are exerted on the valve body 252 when the valve 250 is in the closed position.

FIG. 7 depicts the first valve 650 in cross-section through Section A—A of FIG. 6. In this cross-section, the full throughbore 750 and the fowling mechanism 665 of the valve 250 is more clearly depicted. The body 252 of the valve 250 includes a D-shaped cutout section 760 that can not be seen in FIG. 2. The D-shaped cutout section 760 enables fluid flow through annular area 249 past the plug 254 of the valve 250 through the valve body 252 when the valve 250 is in the closed position. Although the cutout section 760 is depicted as being D-shaped in FIG. 7, one of ordinary skill in the art will readily appreciate that the section 760 could be any other shape that would allow fluid to bypass the plug 254.

With the cementing manifold 200 in the holding position as shown in FIG. 2, the fluid flows along the path represented by the flow arrows. Namely, the drilling fluid would first flow into the throughbore 214 of the upper cap 210, then out through the flow slots 246 in the dart canister 240, and down through the annular area 249 between the dart canister 240 and housing 220 in the housing throughbore 224. Because both valves 250, 270 are closed, there is no flow path through the plug 254 of the first valve 250, so the flow will bypass the plug 254 through the D-shaped section 760 in the valve body 252. The flow will continue into the annular area 249 between the sphere holder 260 and the lower cap 230. Again, because the second valve 270 is closed, there is no straight flow path through the plug 274 of the second valve 270, so flow will move through the body 272 via the D-shaped section. However, because there is an open flow path below the lower cap 230, the fluid will flow into the throughbore 285 of the second valve 270, through the transverse bore 287 of the second valve 270, and downwardly into the drill string 108.

Figure 9:
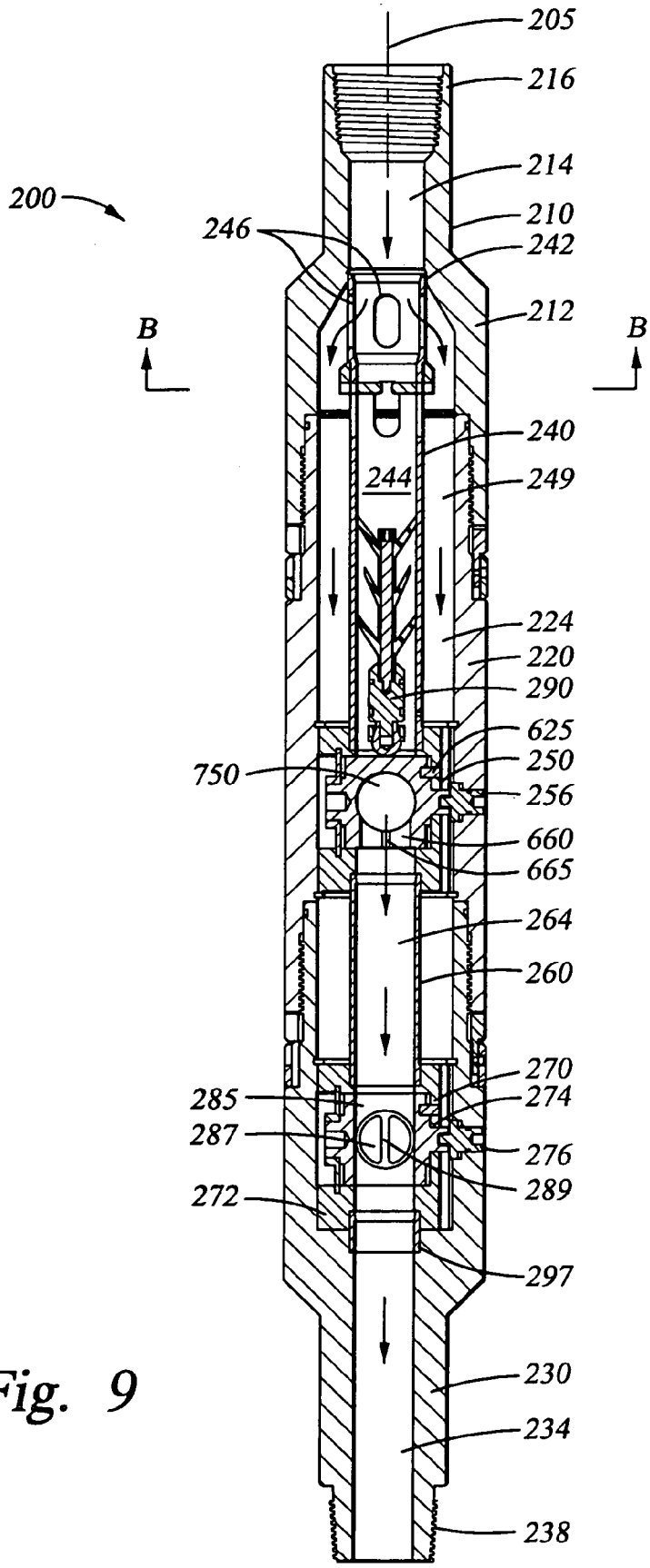
FIG. 9 is a cross-sectional side view of the single dart/single sphere cementing manifold of FIG. 2 after the sphere has been dropped, with the first valve closed and the second valve open.

When a valve 250, 270 is turned, the flow path through the manifold 200 changes. Referring to FIG. 9, the second valve 270 has been actuated by rotating the valve plug 274 by 90 degrees with respect to the valve body 272, thereby opening the valve 270 and dropping the sphere 295. In the rotated position, the transverse bore 287 of the valve 270 is disposed perpendicular to the longitudinal axis 205 of the manifold 200, and the fouling mechanism 289 is no longer in the flow path. The throughbore 285 in the second valve plug 274 is aligned with the longitudinal axis 205 of the manifold 200, thereby becoming open and providing an opening for the sphere 295 to drop down into the throughbore 234 of the lower cap 230.

Thus, as shown in FIG. 9, once the sphere 295 has dropped, the second valve 270 will be in the dropping position with an open throughbore 285 aligned with the throughbores 264, 234 of the sphere canister 260 and the lower cap 230, respectively, and the first valve 250 will remain in the holding position. In this configuration, as referenced by the flow arrows, the drilling fluid flows into the throughbore 214 of the upper cap 210, through the flow slots 246 of the dart canister 240, into the annular area 249 between the dart canister 240 and the housing 220, and into the D-shaped section 760 of the first valve 250. Because there is an open flow path below the first valve 250, the fluid then flows into the throughbore 750 through end 752 of valve plug 252 and downwardly through the transverse bore 660, the sphere canister 260, the throughbore 285 of the second valve 270, and downwardly into the drill string 108.

Figure 10:
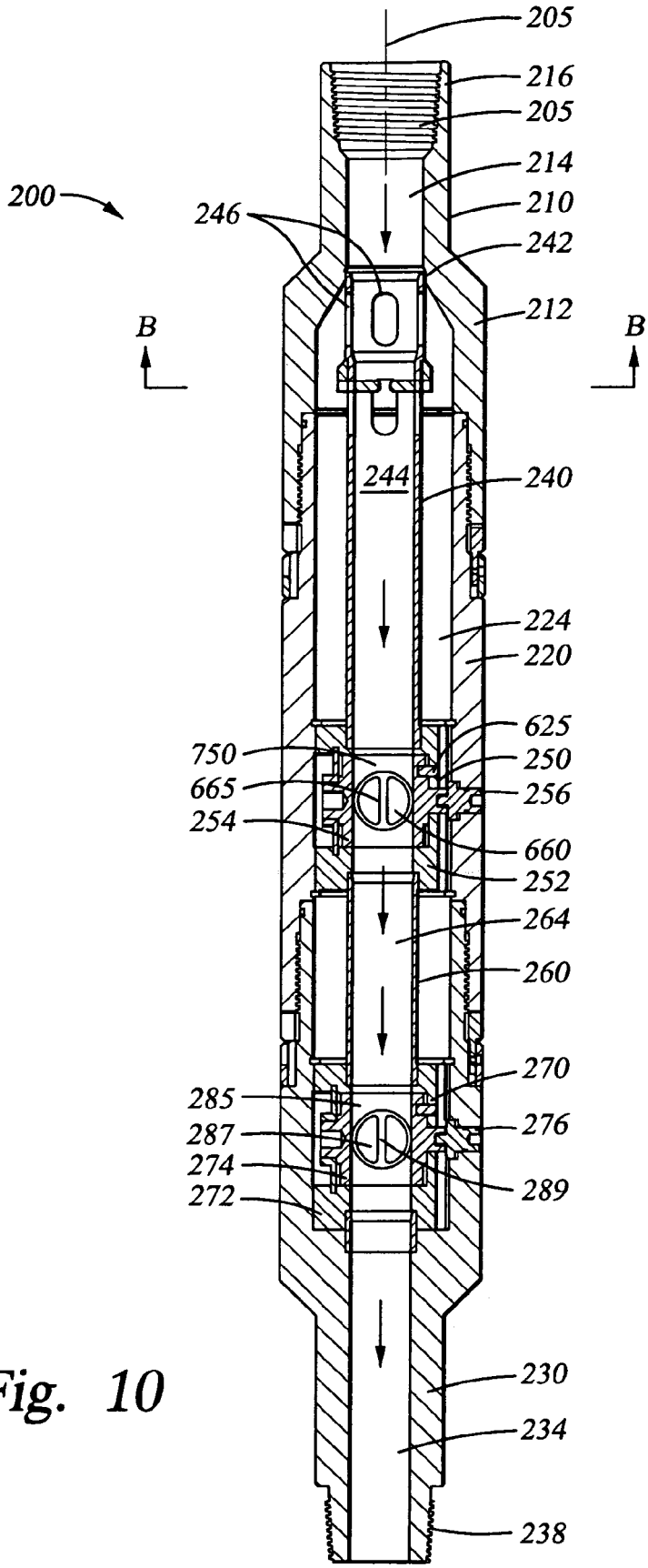
FIG. 10 is a cross-sectional side view of the single dart/single sphere cementing manifold of FIG. 2 after both the sphere and the dart have been dropped, with both valves open.

Referring to FIG. 10, after the cement has been pumped through the manifold 200 in the position shown in FIG. 9, the valve plug 254 of the first valve 250 is rotated by 90 degrees with respect to the valve body 252 to open valve 250 and drop the dart 290. In the rotated position, the transverse bore 660 is disposed perpendicular to the longitudinal axis 205 of the manifold 200 and the fouling mechanism 665 is no longer in the flow path. The throughbore 750 in the first valve plug 254 is aligned with the longitudinal axis 205 of the manifold 200, thereby providing an opening for the dart 290 to drop down into the throughbore 264 of the sphere canister 260, through the second valve 270 and lower cap 230, and down into the drill string 108. Thus, when the first valve 250 is rotated to drop the dart 290, the throughbore 750 of the valve plug 254 is aligned to allow flow straight through the cementing manifold 200 and down into the drill string 108. This position of the cementing manifold 200 is called the dropping position.

The single dart/single sphere manifold 200 shown in FIG. 2 is reconfigurable to accommodate multi-darts or multi-spheres, such as, for example, the dual dart/single sphere manifold 300 as shown in FIG. 3. In many respects, the manifold 300 includes the same components as the manifold 200 of FIG. 2, but also includes an additional housing 320, an additional dart holder 340, and an additional dropping/holding valve 350 comprising a valve body 352, a valve plug 354, and a valve stem 356. Thus, the housing 220 of the single dart/single sphere cementing manifold 200 is preferably modular in design to enable additional housings, such as housing 320, to be stacked together and interconnected between the upper cap 210 and the lower cap 230. Further, all of the valves 250, 270, 350 are preferably identical and interchangeable. This enables the operator to stack as many dart or sphere combinations as desired.

In contrast, the multi-dart or multi-sphere cementing manifolds of the prior art were either purpose-built or required the interconnection of single manifolds stacked together, creating a very long cementing manifold. In the multi-dart manifold 300 shown in FIG. 3, rather than adding approximately 8 feet by connecting two single dart manifolds together, only the length of the additional housing 320 is added, which is approximately 3½ feet long.

When only a single dart 290 is dropped from the manifold 200 of FIG. 2, some of the cement at the leading end mixes with the previously pumped drilling fluid to form a contaminated mixed fluid termed "rotten cement." Thus, as previously described, the dual dart manifold 300 may be desired to prevent the cement from mixing with drilling fluid downhole, especially if only a small quantity of cement will be pumped. Thus, after the sphere 295 is dropped from the manifold 300 of FIG. 3, the first dart 390 is dropped immediately before the cement is flowed downhole, and the second dart 290 is dropped immediately following the flow of cement downhole to provide containment and prevent the cement from mixing with drilling fluid downhole.

FIG. 4 depicts a modified cementing manifold 400 containing only a large elastomeric sphere 495. The cementing manifold 400 comprises the upper cap 210, lower cap 230, and a single valve 270 that acts as the sphere holding/dropping mechanism, which are the same components used in the manifolds 200, 300 of FIGS. 2 and 3, respectively. However, a specially designed larger sphere canister 460 is disposed above the valve 270 within the upper cap 210 and lower cap 230. Canister 460 includes an upper enlarged bore 462 and a lower reduced diameter bore 464 forming a conical shaped transition 466 therebetween. The enlarged sphere 495 is received within enlarged bore 462 and then by means of transition 466 is forced into reduced diameter bore 464 for launching downhole. The elastomeric material of sphere 495 allows sphere 495 to compress to fit within reduced diameter bore 464.

Thus, the preferred cementing manifolds 200, 300, 400 of the present invention comprise a number of advantages. In particular, the manifolds 200, 300, 400 are preferably easily assembled and disassembled, providing reloading capability in the field. The manifolds 200, 300, 400 preferably include dogs 280 that allow high torque transmission without requiring pre-torque at the threaded connections. Additionally, the manifolds 200, 300, 400 preferably include modular housings 220, 320 that can be stacked together and interconnected to add multi-dart or multi-sphere capability, as desired, thereby providing a high degree of flexibility. Further, the manifolds 200, 300, 400 preferably include identical, interchangeable valves 250, 270, 350 that require only a 90° turn to open or close. The valves 250, 270, 350 are preferably pressure balanced to minimize resistance to rotation, thereby enabling release of the darts 290, 390 and spheres 295, 495 while flowing. The valves 250, 270, 350 also preferably include large throughbores 750, 285, 385 to minimize flow erosion. Additionally, the manifolds 200, 300, 400 preferably provide internal bypass capability, internally loaded darts 290, 390 and spheres 295, 495, and valve bodies 252, 272, 352 that install internally. Thus, only the small diameter valve stems 256, 276, 356 protrude externally from the pressure containing housings 220, 320 and lower cap 230, thereby minimizing penetrations that act as stress concentration areas. Further, there are no externally mounted components that are welded or threaded.

While preferred embodiments of this invention have been shown and described, modifications thereof can be made by one skilled in the art without departing from the spirit or teaching of this invention. The embodiments described herein are exemplary only and are not limiting. Many variations and modifications of the apparatus and methods are possible and are within the scope of the invention. Accordingly, the scope of protection is not limited to the embodiments described herein, but is only limited by the claims that follow, the scope of which shall include all equivalents of the subject matter of the claims.

What is claimed is:

1. An apparatus for cementing a string of tubulars in a borehole, the apparatus comprising:

an enclosure having a bore therethrough;

an axially fixed sphere canister having a sphere aperture therethrough;

a sphere valve member having a valve body disposed internally of said bore; and a sphere disposed in said sphere aperture;

wherein said sphere valve member has a hold position closing said sphere aperture and a drop position opening said sphere aperture to release said sphere.

2. The apparatus of claim 1 further comprising:

a dart canister having a dart aperture therethrough;

a dart valve member having a valve body disposed internally of said bore; and a dart disposed in said dart aperture;

wherein said dart valve member has a hold position closing said dart aperture and a drop position opening said dart aperture to release said dart.

3. The apparatus of claim 2 wherein said dart canister includes a retention member.

4. The apparatus of claim 2 wherein said valve members are moveable from said hold to said drop positions when fluid is flowing through said bore.

5. The apparatus of claim 2 wherein said valve members are identical.

6. The apparatus of claim 2 wherein said canisters include equalizing ports.

7. The apparatus of claim 2 wherein said dart canister includes flow slots.

8. The apparatus of claim 2 further including flow by-passes around said sphere and dart valve members through said bore.

9. The apparatus of claim 8 wherein a first flow path is formed when said sphere and dart valve members are in the hold position, said first flow path extending through said bore and said flow by-passes.

10. The apparatus of claim 8 wherein a second flow path is formed when said dart valve member is in said hold position and said sphere valve member is in said drop position, said second flow path extending through said bore, through said by-pass around said dart valve member, and through said sphere valve member.

11. The apparatus of claim 8 wherein a third flow path is formed when said dart and sphere valve members are in the drop position, said third flow path extending through said bore and through said dart and sphere valve members.

12. The apparatus of claim 2 wherein said enclosure includes:

a first member having said bore passing therethrough for fluid flow;

a second member having said bore passing therethrough for fluid flow;

a modular body connecting said first and second members, said modular body having said bore passing therethrough;

said dart canister and dart valve member being mounted within said modular body; and said sphere canister and sphere valve member being mounted within said second member.

13. The apparatus of claim 12 further including a spacer member.

14. The apparatus of claim 12 wherein said first member forms a connection with said modular body and said modular body forms a connection with said second member.

15. The apparatus of claim 14 wherein said connections comprise dogs disposed within aligned slots.

16. The apparatus of claim 15 wherein said dogs are retained by a ring.

17. The apparatus of claim 1 wherein said valve body includes an alignment surface for aligning said valve body within said enclosure.

18. The apparatus of claim 1 further including retaining plates for retaining said valve body within said enclosure.

19. The apparatus of claim 1 wherein said valve body includes a by-pass port therethrough allowing fluid flow around said sphere valve member whether said sphere valve member is in said hold or drop positions.

20. The apparatus of claim 1 wherein said sphere canister comprises two separable portions.

21. The apparatus of claim 1 further including a flow by-pass around said sphere valve member through said bore.

22. The apparatus of claim 1 wherein said sphere valve member further comprises a plug having a hold position and a drop position.

23. The apparatus of claim 22 wherein said plug includes a pass-through passage and a transverse passage, said pass-through passage extending through said plug and said transverse passage extending transversely from said pass-through passage through a side of said plug.

24. The apparatus of claim 23 wherein said pass-through passage and said transverse passage form a T-shaped aperture in said plug.

25. The apparatus of claim 23 further including a fouling member extending into said transverse passage.

26. The apparatus of claim 22 wherein said plug includes rotation bosses on opposing sides thereof, said bosses being received in opposing bores in said valve body for the rotation of said plug within said valve body.

27. The apparatus of claim 22 further comprising a pin disposed between said valve body and said plug.

28. The apparatus of claim 22 further including filler material disposed in recesses around said sphere valve member to prevent the accumulation of debris therein.

29. The apparatus of claim 22 further including an actuation stem extending through a wall of said enclosure and engaging said plug to actuate said plug between said hold and drop positions.

30. The apparatus of claim 29 wherein said actuation stem further comprises a flange that engages a shoulder within said wall.

31. The apparatus of claim 22 wherein said plug is cylindrical or spherical.

32. The apparatus of claim 1 further comprising a swivel.

33. The apparatus of claim 32 further comprising a flag sub.

34. The apparatus of claim 32 further comprising a top drive unit for rotating a drill string through said swivel.

35. The apparatus of claim 32 wherein said swivel further comprises:

an outer stationary member with cement connections; and an inner rotating member with a swivel bore therethrough;

wherein said outer stationary member is formed from one piece.

36. The apparatus of claim 35 wherein said swivel further comprises angled ports extending between said cement connections and said swivel bore.

37. The apparatus of claim 35 further including seals disposed between said outer stationary member and said inner rotating member.

38. The apparatus of claim 37 wherein seals are disposed within a shoulder of the outer stationary member.

39. The apparatus of claim 37 wherein said inner rotating member includes a common diameter in the area where the seals are disposed.

40. An apparatus for cementing a string of downhole tubular members in a borehole, comprising:

an upper member;

a first launching unit including a first dart canister and a first dart valve member disposed within a first modular member;

a second launching unit including a second dart canister and a second dart valve member disposed with a second modular member; and a third launching unit including a sphere canister and a sphere valve member disposed within a lower member;

wherein at least one of said canisters is axially fixed; and wherein at least one of said dart valve members comprises a valve body disposed internally of a bore within at least one of said modular members.

41. The apparatus of claim 40 wherein said second launching unit is interchangeable with said first launching unit.

42. The apparatus of claim 40 wherein said valve members are interchangeable.

43. The apparatus of claim 40 wherein any number of launching units may be added between said upper member and said third launching unit.

* * * * *